US008547282B2

(12) United States Patent
Park et al.

(10) Patent No.: US 8,547,282 B2
(45) Date of Patent: Oct. 1, 2013

(54) MIMO ANTENNA AND COMMUNICATION DEVICE USING THE SAME

(75) Inventors: Se-hyun Park, Suwon-si (KR); Dong-jin Kim, Yongin-si (KR); Byung-tae Yoon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/426,032

(22) Filed: Mar. 21, 2012

(65) Prior Publication Data

US 2013/0050052 A1 Feb. 28, 2013

Related U.S. Application Data

(62) Division of application No. 12/112,033, filed on Apr. 30, 2008, now Pat. No. 8,164,525.

(30) Foreign Application Priority Data

Oct. 17, 2007 (KR) ..... 10-2007-0104549

(51) Int. Cl.
*H01Q 1/38* (2006.01)

(52) U.S. Cl.
USPC ..... 343/700 MS; 343/702; 343/876

(58) Field of Classification Search
USPC ..... 343/700, 702, 829, 846, 876
See application file for complete search history.

(56) References Cited

U.S. PATENT DOCUMENTS

| | | | | |
|---|---|---|---|---|
| 2,541,021 | A * | 2/1951 | Baum | 343/736 |
| 3,050,730 | A * | 8/1962 | Lamberty | 343/792.5 |
| 4,750,000 | A * | 6/1988 | Schroeder | 343/853 |
| 5,550,554 | A | 8/1996 | Erkocevic | |
| 6,542,128 | B1 * | 4/2003 | Johnson et al. | 343/742 |
| 7,477,201 | B1 * | 1/2009 | Bit-Babik et al. | 343/702 |
| 2002/0140612 | A1 | 10/2002 | Kadambi et al. | |
| 2003/0222823 | A1 | 12/2003 | Flint et al. | |
| 2004/0233111 | A1 | 11/2004 | Desclos et al. | |
| 2005/0153756 | A1 | 7/2005 | Sato et al. | |
| 2007/0205959 | A1 | 9/2007 | Nakaya et al. | |
| 2007/0285334 | A1 * | 12/2007 | Tsutsumi et al. | 343/893 |
| 2009/0073047 | A1 | 3/2009 | Le Bolzer et al. | |

FOREIGN PATENT DOCUMENTS

| | | |
|---|---|---|
| EP | 1 555 715 | 7/2005 |
| EP | 1 830 485 A1 | 9/2007 |
| FR | 2 888 675 | 1/2007 |

(Continued)

OTHER PUBLICATIONS

Extended European Search Report issued on Feb. 16, 2010, in corresponding European Application No. 08160630.3 (7 pages).

(Continued)

*Primary Examiner* — Tho G Phan
(74) *Attorney, Agent, or Firm* — NSIP Law

(57) ABSTRACT

A multiple-input multiple-output (MIMO) antenna and a communication device using the same is provided. The MIMO antenna includes a plurality of antenna elements in which a feeding unit is formed at one end, and another end is connected to a ground, and a connection unit which connects the antenna elements.

17 Claims, 4 Drawing Sheets

(56) References Cited

FOREIGN PATENT DOCUMENTS

| | | | |
|---|---|---|---|
| JP | 09-260925 | | 10/1997 |
| JP | 2005-086780 | | 3/2005 |
| JP | 2005-203878 | A | 7/2005 |
| JP | 2007-235762 | A | 9/2007 |
| KR | 10-2005-0112272 | | 2/2007 |
| WO | WO 02/058187 | | 7/2002 |
| WO | WO 2004/084344 | | 9/2004 |
| WO | WO 2007/006982 | A1 | 1/2007 |

OTHER PUBLICATIONS

Japanese Office Action issued on Jan. 29, 2013, in counterpart Japanese Application No. 2008-187830 (6 pages, including 2 pages in Japanese and 4 pages of a complete English translation).

* cited by examiner

MIMO ANTENNA AND COMMUNICATION DEVICE USING THE SAME

CROSS-REFERENCE TO RELATED APPLICATIONS

This application is a division of pending application Ser. No. 12/112,033, filed on Apr. 30, 2008, which claims the benefit under 35 U.S.C. §119(a) of a Korean Patent Application No. 10-2007-0104549, filed on Oct. 17, 2007, in the Korean Intellectual Property Office, the entire disclosure of which is incorporated herein by reference for all purposes.

BACKGROUND

1. Field

The following description relates to communication devices, and, for example, a multiple-input multiple-output (MIMO) antenna and wireless communication devices using the same.

2. Description of Related Art

With the demand for multimedia services of high quality in a wireless communication environment, there has been a need for a wireless transmission technique that delivers massive data at a higher rate and a lower error rate.

In order to achieve higher data transmission rates, a multi-band antenna system has been proposed. Generally, a multi-band antenna system includes a plurality of antennas, a plurality of band pass filters (BPFs), and a plurality of radio frequency (RF) circuits. Each antenna transmits and/or receives signals in different frequency bands, and each BPF and RF circuit processes signals transmitted and received through each antenna. However, use of a plurality of antennas is necessarily required which may increase the size of the antenna system.

In a multiple-input multiple-output (MIMO) antenna, an MIMO operation is carried out by arranging a plurality of antennas in a specific structure. Accordingly, it is possible to increase the data transfer rate in a specific range or expand a system range for a specific data transfer rate.

A MIMO antenna, which is believed to be the next-generation mobile communication technique applicable to mobile terminals and repeaters far and wide, is attracting attention as a new solution to overcome the limited transmission quantity of the mobile communications and wireless communication devices. It is believed that a MIMO antenna will allow for high speed broadband communication, high bandwidth, improved communication range, and high mobility. A MIMO antenna may be operated in broad or multiple frequency bands and may also improve data transmission rate between wireless communication devices.

Generally, a plurality of antennas having the same capability is embodied in a MIMO antenna. To install the MIMO antenna in a small terminal, the interval between the antennas may be narrowed. However, electromagnetic waves radiated from the antennas may interfere with each other in that situation.

The antennas may be spaced from each other at a predetermined interval, or additional devices such as a slit may be mounted to the MIMO antenna to prevent the interference between the antennas.

However, it has been difficult to reduce the interference between the antennas despite the antennas being spaced from each other at a predetermined interval.

Furthermore, the size of the MIMO antenna is increased due to the presence of the predetermined interval or the additional devices.

SUMMARY

In one general aspect, there is provided a multiple-input multiple-output (MIMO) antenna, including a plurality of antenna elements in which a feeding unit is formed at one end, and another end is connected to a ground, and a connection unit which connects the antenna elements.

The general aspect of the antenna may further provide that the antenna elements and the connection unit are formed in a single body.

The general aspect of the antenna may further provide that the connection unit connects the antenna elements to be arranged substantially at a right angle.

The general aspect of the antenna may further provide that the ground is provided on a substrate, and the antenna elements are arranged with respect to a corner of the ground or a corner of the substrate.

The general aspect of the antenna may further provide that at least one of the antenna elements is a strip bent in a substantially loop shape.

The general aspect of the antenna may further provide a switching unit which switches the feeding unit so that power is supplied to one of the antenna elements.

The general aspect of the antenna may further provide that the feeding unit is formed at one end of each of the antenna elements and another end of each of the antenna elements is connected to the ground.

The general aspect of the antenna may further provide at least one switching unit provided to supply power concurrently to each of the antenna elements, or selectively to one of the antenna elements.

The general aspect of the antenna may further provide that the MIMO antenna includes a first antenna unit including the plurality of antenna elements in which the feeding unit is formed at the one end, and the another end is connected to the ground, and the connection unit which connects the antenna elements, and a second antenna unit including a plurality of antenna elements in which a feeding unit is formed at one end, and another end is connected to the ground or to another ground, and a connection unit which connects the antenna elements of the second antenna unit.

A communication device may include the general aspect of the antenna.

In another general aspect, a multiple-input multiple-output (MIMO) antenna is provided, including a plurality of antenna elements, each of the antenna elements including an end that is connected to a corresponding one of a plurality of feeding units, and an other end that is connected to a ground, each of the antenna elements being formed adjacent to the ground, and a connection unit that connects the plurality of antenna elements.

Another general aspect of the antenna may further provide that the plurality of antenna elements and the connection unit are formed in a single body.

Another general aspect of the antenna may further provide that the connection unit connects the plurality of antenna elements substantially at a right angle.

Another general aspect of the antenna may further provide that the ground is provided on a substrate, and the plurality of antenna elements is arranged with respect to a corner of the ground or a corner of the substrate.

Another general aspect of the antenna may further provide that at least one of the antenna elements is a strip bent in a substantially loop shape.

Another general aspect of the antenna may further provide a switching unit configured to switch the feeding unit of each of the antenna elements to control an amount of power supplied to each of the antenna elements.

Another general aspect of the antenna may further provide at least one switching unit provided to supply power concurrently to each of the antenna elements, or selectively to one of the antenna elements.

Another general aspect of the antenna may further provide a first antenna unit comprising the plurality of antenna elements, and a second antenna unit including a plurality of second antenna elements, each of the second antenna elements including an end that is connected to a corresponding one of a plurality of second feeding units, and an other end that is connected to the ground or to an other ground, each of the second antenna elements being formed adjacent to the ground or to the other ground, and a second connection unit that connects the plurality of second antenna elements.

A communication device may include the other general aspect of the antenna.

Other features and aspects may be apparent from the following detailed description, the drawings, and the claims.

Figure 1:
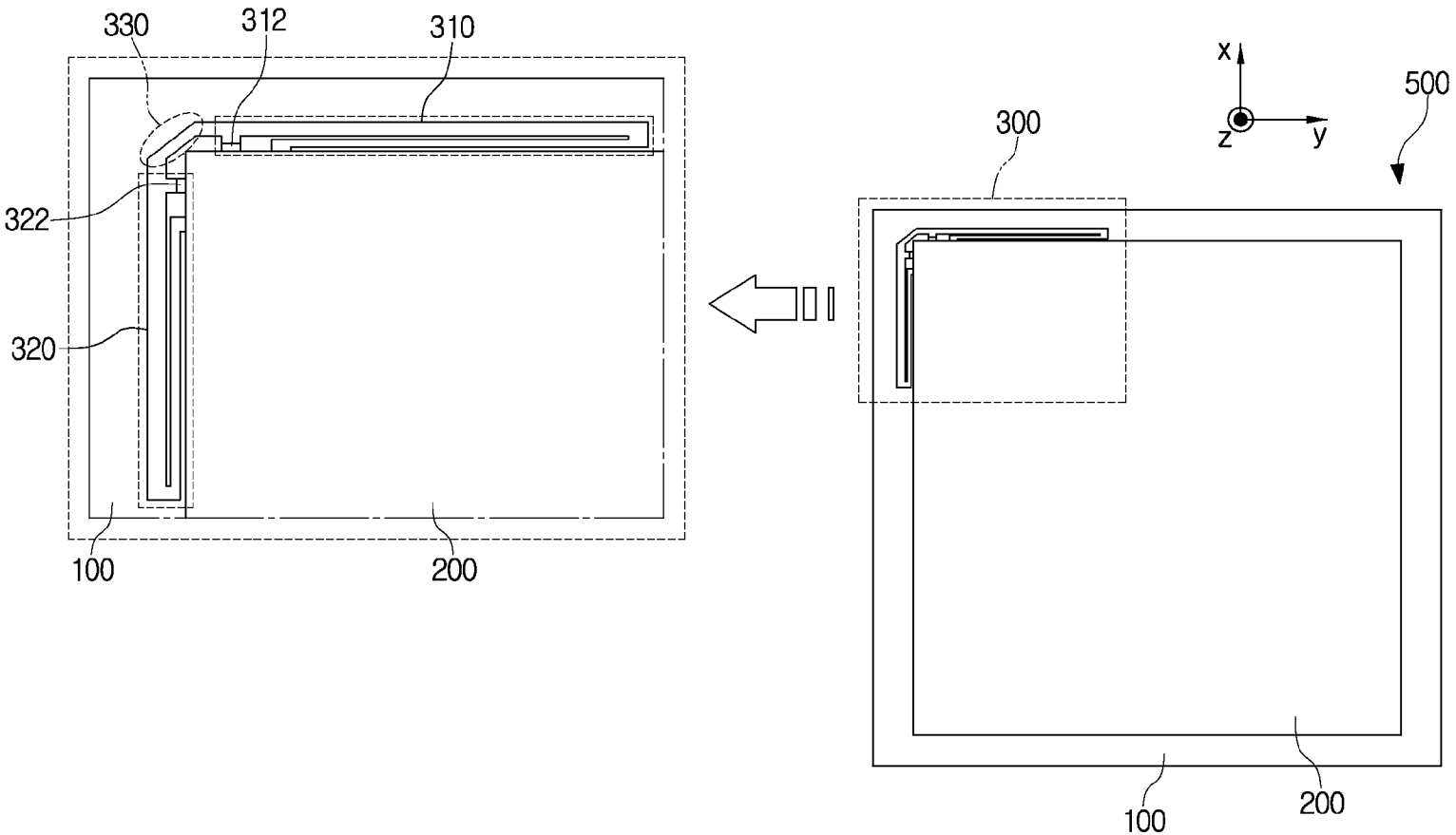
FIG. 1 is a configuration diagram illustrating an example of a MIMO antenna.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. In addition, descriptions of well-known functions and constructions may be omitted for increased clarity and conciseness.

FIG. 1 is a configuration diagram illustrating an example of a MIMO antenna 500.

As illustrated in FIG. 1, a multiple-input multiple-output (MIMO) antenna 500 includes a substrate 100, a ground 200, and an antenna unit 300.

The ground 200 is formed on the substrate 100. The size of the ground 200 may be smaller than that of the substrate 100. The antenna unit 300 is mounted at an outside corner of an overlapped area of the substrate 110 and the ground 200.

The antenna unit 300 may include antenna elements 310, 320, and a connection unit 330 that connects the antenna elements 310, 320.

It will be understood from the following description that FIG. 1 is only an example and a MIMO antenna may include more than one antenna unit 300. Moreover, the structure of the antenna elements 310, 320 is also only an example.

For ease of description, the antenna element 310 will be referred to as a first antenna element, and the antenna element 320 will be referred to as a second antenna element. The first antenna element 310 is arranged in a horizontal direction 'y', and the second antenna element 320 is arranged in a vertical direction 'x.' The first antenna element 310 and the second antenna element 320 may form an integral unit by way of the connection unit 330.

Feeding units 312, 322 are formed respectively at one end of each of the first and second antenna elements 310, 320. An other end of each of the first and second antenna elements 310, 320 is connected to the ground 200. The first and second antenna elements 310, 320 may be formed in a strip shape. Each of the first and second antenna elements 310, 320 may be bent in a substantially loop shape, and the bent strips may be parallel with each other. The first and second antenna elements 310, 320 may be formed in a '⊏' configuration, and connected to the ground 200 so that the first and second antenna elements 310, 320 may be formed in a folded loop configuration.

The total length of the first and second antenna elements 310, 320 may have a length of 1 wavelength. In FIG. 1, the bodies of the first and second antenna elements 310, 320 are bent, and the bent bodies are shaped in a loop configuration. Therefore, longer antenna elements may be provided in the same space.

The feeding units 312, 322 connected to one end of each of the first and second antenna elements 310, 320 may be protruded toward or extend from the ground 200, and the other end of each of the first and second antenna elements 310, 320 may be connected to the ground 200.

The connection unit 330 connects the first and second antenna elements 310, 320. Each of the feeding units 312, 322 is positioned adjacent to each other, and the first and second antenna elements 310, 320 are arranged at a predetermined angle. The connection unit 330 and the first and second antenna elements 310, 320 may be formed as a single unit or body. Therefore, the antenna elements 310, 320, connected to each other by the connection unit 330, may be operated as a single antenna element. Accordingly, an antenna unit may include an antenna element having a plurality of feeding units. The antenna unit may be arranged with respect to a boundary of a ground to, for example, take less space and reduce the size of a wireless communication device using the antenna unit.

The connection unit 330 may connect the first and second antenna elements 310, 320, so that the first and second antenna elements 310, 320 may be arranged at a right angle. It is understood that the angle formed by the first and second antenna elements 310, 320 may be varied. Where the antenna elements 310, 320 are connected at a predetermined angle, such as a right angle, a mutual interference between the first and second antenna elements 310, 320 may be minimized. Accordingly, the antenna elements 310, 320 may be arranged to prevent interference and/or correlation.

In FIG. 1, the first and second antenna elements 310, 320 connected by the connection unit 330 correspond to a corner of the ground 200. In this case, each of the first and second antenna elements 310, 320 are arranged substantially parallel with each of two sides extended from the corner of the ground 200. Therefore, the antenna unit 300 is provided around a corner of the ground 200.

While only one antenna unit 300 is provided in FIG. 1, the number of antenna unit is not limited thereto. For example, the antenna units 300 may be mounted with respect to four corners of a substantially rectangular ground 200. It is also understood that the ground 200 may be formed in a variety of different shapes, as may be the case in various wireless communication devices, and antenna unit 300 or an antenna unit consistent with the disclosure provided herein may be provided with respect to such a ground accordingly.

Where power is concurrently supplied to the first and second antenna elements 310, 320, one of the first and second antenna elements 310, 320 receives a maximum electric field, and the other of the first and second antenna elements 310, 320 receives a minimum electric field.

Therefore, the first and second antenna elements 310, 320 operate independently, and the mutual electric interference between the first and second antenna elements 310, 320 may be suppressed.

While the antenna unit 300 is parallel with the ground 200 on the substrate 100 as illustrated in FIG. 1, it is not limited thereto. For example, the antenna unit 300 may be arranged locally at a corner of the ground 200.

The power may be concurrently supplied to the first and second antenna elements 310, 320, or selectively supplied to one of the first and second antenna elements 310, 320.

Where the power is concurrently supplied to first and second antenna elements 310, 320, at a peak of an electric field intensity of the first antenna element 310, an electric filed intensity of the second antenna element 320 may reach a minimum, or at a peak of an electric field intensity of the second antenna element 320, an electric field intensity of the first antenna element 310 may reach a minimum. Therefore, a coupling of the radiation patterns between the first and second antenna elements 310, 320 may be minimized.

While an electric field is generated around the first and second antenna elements 310, 320, an electric field is not generated around the ground 200. Therefore, the antenna characteristic may be irrespective of the size of the ground 200. As noted above, the size, location, and shape of the ground 200 may be flexibly changed according to a type of terminal applying a MIMO antenna.

Where the power is supplied to one of the first and second antenna elements 310, 320, an electric field is generated around the first and second antenna elements 310, 320 such that an electric field is generated around the antenna element 310 or 320 receiving the power, and an electric field is generated around the other antenna element 310 or 320 not receiving the power at phase difference of substantially 90 degrees. According to another aspect, where the power is concurrently supplied to the first and second antenna elements 310, 320, the first and second antenna elements 310, 320 have electric fields that are out of phase by 90 degrees.

Figure 2A:
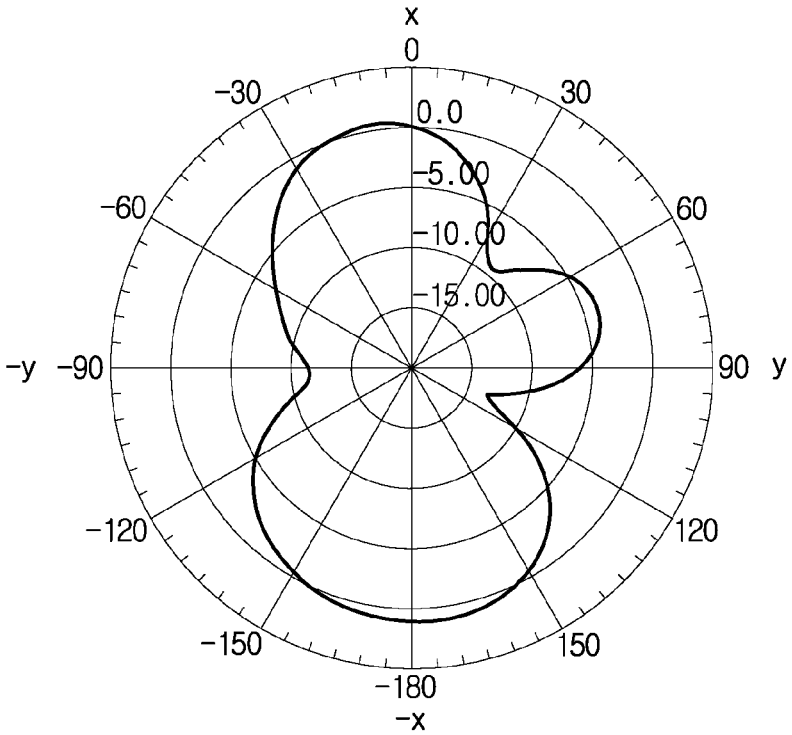
FIGS. 2A and 2B are graphs illustrating examples of radiation patterns of a MIMO antenna.
Figure 2B:
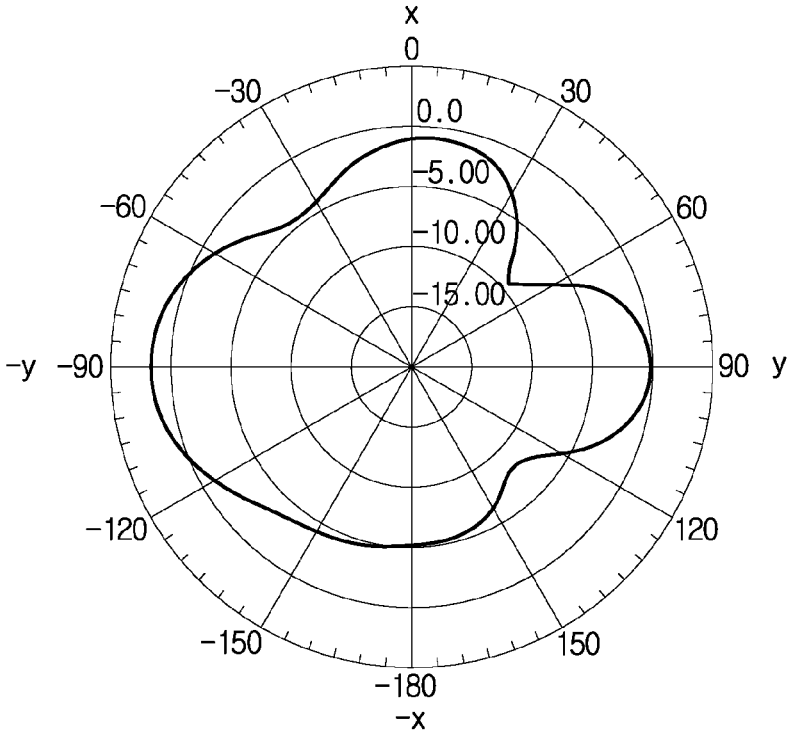

FIGS. 2A and 2B are graphs illustrating examples of radiation patterns of a MIMO antenna.

FIG. 2A illustrates a radiation pattern where power is supplied to only the feeding unit 312 of the first antenna element 310. A radiation pattern of the first antenna element 310 is formed in an X-axis direction.

FIG. 2B illustrates a radiation pattern where power is supplied to only the feeding unit 322 of the second antenna element 320. A radiation pattern of the second antenna element 320 is formed in a Y-axis direction.

Accordingly, the radiation patterns of the first and second antenna elements 310, 320 may be formed in an opposite or an orthogonal direction with respect to each other. In a general MIMO antenna, radiation patterns have been found to overlap so that a mutual interference occurs among the antennas of the general MIMO antenna. As illustrated in FIGS. 2A and 2B, the radiation patterns of the first and second antenna elements 310, 320 cross each other. Accordingly, a mutual interference caused by a radiation pattern coupling is prevented.

A scattering (S)-parameter is measured to represent frequency response characteristics of a MIMO antenna. For example, S11 represents that a signal is input and output to and from port 1. That is, a return loss of the first antenna element 310 is expressed as S11, and a return loss of the second antenna element 320 is expressed as S22. The S-parameter for a pair of ports 1, 2 is expressed as S12 or S21. Where a signal is input to port 2, and the signal is output from port 1, a return loss of the signal is expressed as S21, and a user may know the amount of the signal obtained from port 1. Where passive elements are used, S12 is equal to S21. In the case of a MIMO antenna, the lower S11, S22, S12, and S21 applicable at a resonance frequency are, the better an antenna efficiency may be.

In the MIMO antenna according to an example, S21 is measured as approximately −20 dB at a center frequency band while the first and second antenna elements 310, 320 are connected. As the low parameter indicates, the MIMO antenna has a high efficiency.

To determine a mutual interference of the example MIMO antenna, a correlation coefficient of the MIMO antenna is estimated using a radiation pattern and S-parameter.

It was found that the correlation coefficient estimated using the radiation pattern and S-parameter has a value 0 at the center frequency band of the MIMO antenna. That is, it was found that a mutual interference hardly occurs between the first and second antenna elements 310, 320.

Figure 3A:
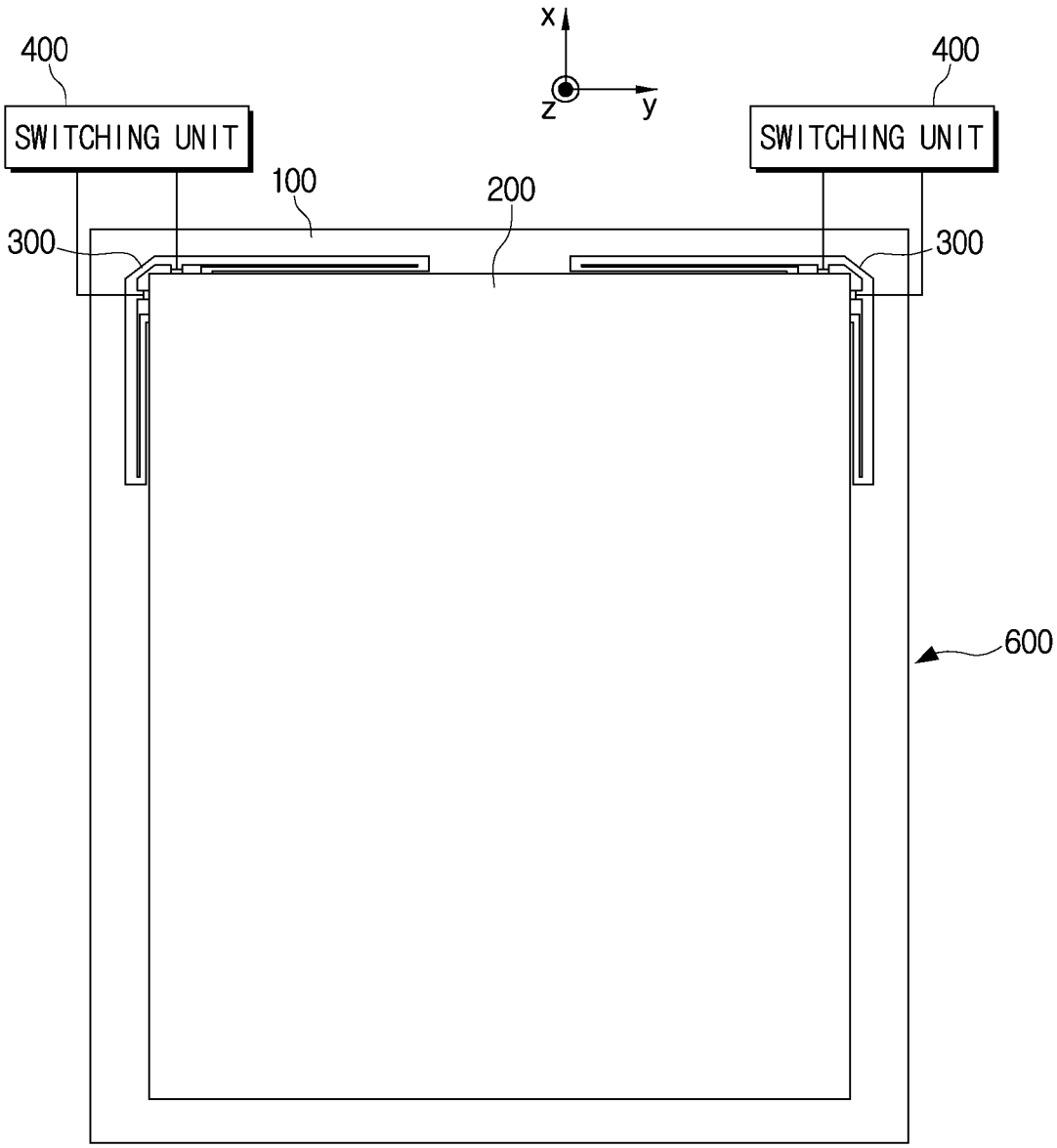
FIGS. 3A and 3B are configuration diagrams illustrating another example of a MIMO antenna.
Figure 3B:
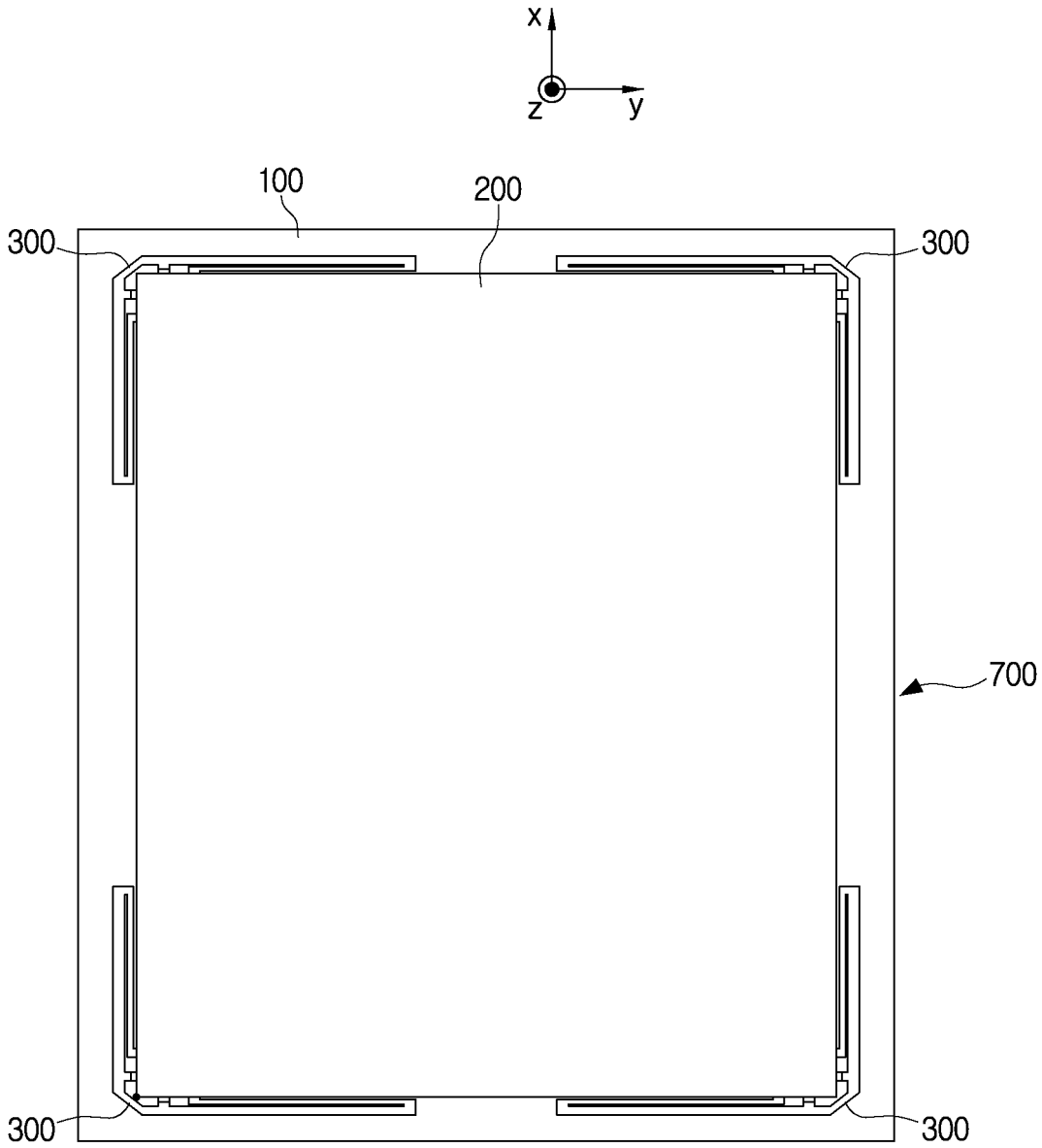

FIGS. 3A and 3B are configuration diagrams illustrating other examples 600, 700 of a MIMO antenna.

FIG. 3A illustrates a MIMO antenna 600 having two antenna units 300. The antenna units 300 are disposed at two upper corners of a ground 200 on a substrate 100. The two antenna units 300 may be symmetrically placed. For ease of description, antenna elements of the antenna units 300 are referred to as a first antenna element #1, a second antenna element #2, a third antenna element #3, and a fourth antenna element #4 from left to right of FIG. 3A.

It is understood that one or more of the four antenna elements #1, #2, #3, #4 may operate. For example, each of the antenna units 300 may have a switching unit 400 to control the corresponding feeding units 312, 322, and power may be supplied to one of the antenna elements 310, 320 (see FIG. 1). That is, the antenna elements #1, #2, #3, #4 of the MIMO antenna 600 may be selectively operated such that, for example, two out of four antenna elements #1, #2, #3, and #4 may operate. As a further example, the MIMO antenna 600 may be operated such that the antenna elements #1 or #2, and #3 or #4 have a higher electric field.

The power may be supplied to one or more of the antenna elements #1, #2, #3, #4 by way of the one or more switching units 400, or by other methods and/or apparatuses known or to be known to one skilled in the art.

FIG. 3B illustrates an example MIMO antenna 700 having four antenna units 300. In this embodiment, a substrate 100 and a ground 200 of substantially rectangular configuration have four corners, respectively, and the four antenna units 300 are provided with respect to the corners of the ground 200 on the substrate 100.

As described above with respect to FIG. 3A, all the antenna elements of the MIMO antenna 700 may operate, or the antenna elements may be selectively operated.

A switching unit is not illustrated in FIG. 3B, but may be provided as illustrated in FIG. 3A.

The two antenna units 300 of FIG. 3A may operate as two-MIMO antennas, in which the antenna elements #1, #2, #3, and #4 may be associated into, for example, the first and third antenna elements #1, #3, the first and fourth elements

#1, #4, the second and third antenna elements #2, #3, and the second and fourth antenna elements #2, #4. The four antenna units 400 of FIG. 3B may operate as four-MIMO antennas. Each antenna unit 300 may be used as MIMO diversity antennas.

It is understood that example MIMO antennas may be used in a variety of known and to be known communication devices including wireless communication devices and portable or mobile communication devices. As an illustration, such devices include cellular phones, notebook computers, portable media players (PMPs), personal digital assistants (PDAs), and the like.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A multiple-input multiple-output (MIMO) antenna, comprising:

a first antenna unit comprising:

a plurality of first antenna elements in which a first feeding unit is formed at one end and another end is connected to a ground; and a first connection unit which connects the first antenna elements: and a second antenna unit comprising:

a plurality of second antenna elements in which a second feeding unit is formed at one end and another end is connected to the ground or to another ground; and a second connection unit which connects the second antenna elements of the second antenna unit.

2. The MIMO antenna of claim 1, wherein the first antenna elements and the first connection unit are formed in a single body.

3. The MIMO antenna of claim 1, wherein the first connection unit connects the first antenna elements to be arranged substantially at a right angle.

4. The MIMO antenna of claim 1, wherein the ground is provided on a substrate, and the first antenna elements are arranged with respect to a corner of the ground or a corner of the substrate.

5. The MIMO antenna of claim 1, wherein at least one of the first antenna elements is a strip bent in a substantially loop shape.

6. The MIMO antenna of claim 1, further comprising:

a switching unit which switches the first feeding unit so that power is supplied to one of the first antenna elements.

7. The MIMO antenna of claim 1, wherein the first feeding unit is formed at one end of each of the first antenna elements and another end of each of the antenna elements is connected to the ground.

8. The MIMO antenna of claim 7, further comprising at least one switching unit provided to supply power concurrently to each of the first antenna elements, or selectively to one of the first antenna elements.

9. A communication device comprising the MIMO antenna as claimed in claim 1.

10. A multiple-input multiple-output (MIMO) antenna, comprising:

a first antenna unit comprising a plurality of first antenna elements, each of the first antenna elements comprising:

an end that is connected to a corresponding one of a plurality of feeding units; and another end that is connected to a ground, each of the first antenna elements being formed adjacent to the ground;

a first connection unit that connects the plurality of first antenna elements;

a second antenna unit comprising a plurality of second antenna elements, each of the second antenna elements comprising:

an end that is connected to a corresponding another one of the plurality of feeding units; and another end that is connected to the ground or to another ground, each of the second antenna elements being formed adjacent to the ground or to the other ground; and a second connection unit that connects the plurality of second antenna elements.

11. The MIMO antenna of claim 10, wherein the plurality of first antenna elements and the first connection unit are formed in a single body.

12. The MIMO antenna of claim 10, wherein the first connection unit connects the plurality of first antenna elements substantially at a right angle.

13. The MIMO antenna of claim 10, wherein:

the ground is provided on a substrate; and the plurality of first antenna elements is arranged with respect to a corner of the ground or a corner of the substrate.

14. The MIMO antenna of claim 10, wherein at least one of the first antenna elements is a strip bent in a substantially loop shape.

15. The MIMO antenna of claim 10, further comprising:

a switching unit configured to switch the one feeding unit to control an amount of power supplied to each of the first antenna elements.

16. The MIMO antenna of claim 10, further comprising:

at least one switching unit provided to supply power concurrently to each of the first antenna elements, or selectively to one of the first antenna elements.

17. A communication device comprising the MIMO antenna as claimed in claim 10.

* * * * *